US007344116B2

(12) United States Patent
Ficarra et al.

(10) Patent No.: US 7,344,116 B2
(45) Date of Patent: Mar. 18, 2008

(54) RELEASE BRACKET SYSTEM AND METHOD

(75) Inventors: Mark Alan Ficarra, Hempstead, NY (US); Joseph Ficarra, Hempstead, NY (US)

(73) Assignee: North South Machine Shop, Inc., Hempstead, NY (US)

( * ) Notice: Subject to any disclaimer, the term of this patent is extended or adjusted under 35 U.S.C. 154(b) by 242 days.

(21) Appl. No.: 10/908,368

(22) Filed: May 9, 2005

(65) Prior Publication Data

US 2005/0269470 A1 Dec. 8, 2005

Related U.S. Application Data

(60) Provisional application No. 60/576,523, filed on Jun. 2, 2004.

(51) Int. Cl.
*A47K 1/08* (2006.01)

(52) U.S. Cl. ..... 248/311.2; 248/221.11; 248/222.11; 248/222.14; 248/220.22; 248/222.51; 248/223.31; 248/223.41; 248/225.21; 248/230.8; 248/313; 248/229.17; 248/222.12; 248/230.1; 248/315; 248/316.1; 224/250; 224/270; 211/107; 215/388; 24/629; 24/630; 24/633; 24/640

(58) Field of Classification Search ..... 248/221.11, 248/222.11, 222.14, 311.2, 220.22, 222.51, 248/223.31, 223.41, 225.21, 230.8, 313, 248/229.17, 222.12, 230.1, 315, 316.1; 224/270, 224/250; 211/107; 215/388; 24/629, 630, 24/633, 640

See application file for complete search history.

(56) References Cited

U.S. PATENT DOCUMENTS 3,483,865 A * 12/1969 Jansson ..... 128/205.22
3,648,830 A * 3/1972 Graf ..... 206/544
5,271,387 A * 12/1993 Murray ..... 128/200.24
5,390,886 A * 2/1995 Lawner et al. ..... 248/224.7
5,887,836 A * 3/1999 Back ..... 248/221.11
5,906,302 A * 5/1999 Spergel ..... 224/250
5,913,467 A * 6/1999 Berg ..... 224/628
6,068,232 A * 5/2000 Bentley ..... 248/503.1
6,155,524 A * 12/2000 Legler et al. ..... 248/221.11
6,367,753 B1 * 4/2002 Berg ..... 248/222.11
6,736,363 B2 * 5/2004 Field ..... 248/313

(Continued)

OTHER PUBLICATIONS www.scubabottlebudy.com/products.html (2 pages).

(Continued)

*Primary Examiner*—Anita King
*Assistant Examiner*—Nkeisha Dumas
(74) *Attorney, Agent, or Firm*—Snell & Wilmer L.L.P.

(57) ABSTRACT

An improved pony bottle bracket that is light weight, compact, simple to use, and facilitates a quick and easy set-up is disclosed. A push button latch enables a diver to quickly disconnect the pony bottle from the main bottle. The pony tank bracket and base unit bracket are mounted by use of a belt and adjustable band straps. The locking mechanism is self-contained, thereby eliminating or minimizing the use of separate components (e.g., no clevis, hitch, cotter or quick release pins) which may be lost. The bracket also eliminates or reduces the use of any items which may entangle the diver or entangle other objects in the diver's surroundings (e.g., no string, cord, chain or lanyards). The bracket is bidirectional (e.g., reversible) such that the top bracket mount may be rotated between about 0 and 180 degrees.

18 Claims, 8 Drawing Sheets

U.S. PATENT DOCUMENTS 6,830,226 B2 * 12/2004 Field et al. ..... 248/313

OTHER PUBLICATIONS

"Welcome to TigerGear . . . the best Pony Bottle Rapid Mounting System on the planet!" http://tigergear.com/, Apr. 12, 2005 (4 pages).

"Pony Bottle Brackets from Reef Scuba"; http://www.reefscuba.com/bracket.htm, Apr. 12, 2005, (3 pages).

"Sea-lutions, Inc. Manufacturer of Innovative Scuba Products", http://www.sea-lutions.com, Apr. 12, 2005 (4 pages).

"Underwater Searching Technology", http://www.oceanscan.com/home.html, Apr. 12, 2005 (4 pages).

"Aqua Explorers Scuba Diving & Snorketling: Find, Compare, Read Reviews & Buy Online @Yahoo!", http://shopping.yahoo.com/s:scuba%20Diving%20 &%20Snorkeling:browsename=Scuba%20Diving%20..., Apr. 12, 2005, 3 pages).

"Ponybottle bracket, quick draw brackets, ultimate ponybottle bracketscuba, dive, dive equipment", http://www.quickdrawbracket.com/, Apr. 12, 2005 (8 pages).

* cited by examiner

RELEASE BRACKET SYSTEM AND METHOD

CROSS-REFERENCE TO RELATED APPLICATIONS

This application claims priority to, and the benefit of, U.S. Provisional Patent Application Ser. No. 60/576,523, filed on Jun. 2, 2004, and entitled "Bi-directional, Reversible, Exchangeable, Interchangeable, Transportable, Carrier, Support, Holster, Holding, Storage, Retention, Attachable, Apparatus, Article(s), Mounting, Quick Release Latch Device(s) or Bracket(s)", which is hereby incorporated by reference in its entirety.

FIELD OF INVENTION

The invention generally relates to mounting brackets, and more particularly, to a quick-release mounting bracket between a main air tank and a spare tank.

BACKGROUND OF INVENTION

Scuba diving has been continually gaining in popularity and the increased number of divers are always trying to find safer procedures and safer equipment for the sport. One of the common pieces of safety equipment is the spare air tank, often known as a pony bottle tank. A pony bottle tank is typically a separate, self-contained air supply tank system that is completely independent from the main air tank supply unit or system. The pony bottle is often carried for an added measure of protection as a redundant device (e.g., spare) and is usually utilized for emergency situations (e.g., failure of the main tank, low oxygen supply in the main tank, used by a diving partner, etc.). The pony bottle tank is typically attached to the main tank by an inefficient mounting bracket system.

Scuba diving usually requires the diver to focus attention on the surroundings, with little time or freedom to be concerned about the scuba equipment. Moreover, the scuba diver typically carries other objects in his hands (e.g., flashlight, net, spear, etc), so the scuba diver often is not able to efficiently manipulate his equipment. In that regard, the existing pony bottle mounting brackets have the disadvantages of being difficult to use. The existing brackets also often include small, complicated components. Furthermore, the existing brackets usually include excessive components such as, for example, a clevis, hitch, cotter or quick release pin. These components may be difficult to handle and may be easily lost, particularly when scuba diving in dark, rugged terrain where items can fall into the crevices of the rocks. Additionally, scuba diving equipment should not include items that can entangle the diver, plants, rocks, sea life, a partner diver, the diver's hands, or the diver's equipment. Items such as, for example, string, cord, chain or lanyards may get caught or snagged on the diver or the diver's equipment and restrict the diver's movement which may be extremely dangerous while the diver is under the water.

Accordingly, a need exists for a pony bottle having an improved quick-release mounting bracket, wherein the bracket does not include excessive components or items that may entangle a diver.

SUMMARY OF INVENTION

The invention overcomes the disadvantages of the prior art by including an improved pony bottle bracket that is light weight, compact, simple to use, and facilitates a quick and easy set-up. The invention includes a push button latch 62 such that the diver can quickly disconnect the pony bottle from the main bottle. In emergency situations, the invention is configured such that the pony tank is easily disconnected from the main tank. More specifically, the self-contained locking mechanism 50 is activated by the base unit bracket push button 52, supporting hardware and sliding lock latch 60 such that the top unit bracket 80 can be removed or separated with one or more tanks from the base unit bracket 10. The top unit bracket and base unit bracket 10 are mounted, in one embodiment, by use of a belt and adjustable band straps (e.g., hose clamp). The brackets may be attached to any surface, and in one embodiment, to a flat or round surface.

Locking mechanism 50 is self-contained, thereby eliminating or minimizing the use of separate components (e.g., no clevis, hitch, cotter or quick release pins) which may be lost. The bracket also eliminates or reduces the use of any items which may entangle the diver or entangle other objects in the diver's surroundings (e.g., no string, cord, chain or lanyards). The bracket is bidirectional (e.g., reversible) such that the top bracket mount may be rotated between about 0 and 180 degrees. With a proper tank setup, the bracket allows the tanks to be exchangeable or interchangeable from an empty tank to a fresh re-filled or new full tank. With a proper tank setup, the bracket also allows the tanks to be transferable from unit to unit or from person to person.

Only one ⅛ allen key or ⅛ allen wrench is needed to assemble or disassemble the locking mechanism 50 for easy cleaning. The components of the invention are configured in a simplified manner such that the diver may easily service the invention with limited mechanical abilities, along with rebuilding the invention with spare parts which may be re-ordered from the manufacturer. The same bracket may also be utilized for mounting other accessories (e.g., battery packs, lights, canisters, etc.).

BRIEF DESCRIPTION OF THE DRAWINGS

A more complete understanding of the present invention may be derived by referring to the detailed description and claims when considered in connection with the Figures. In the Figures, like numerals refer to similar elements, throughout.

DETAILED DESCRIPTION

Figure 1:
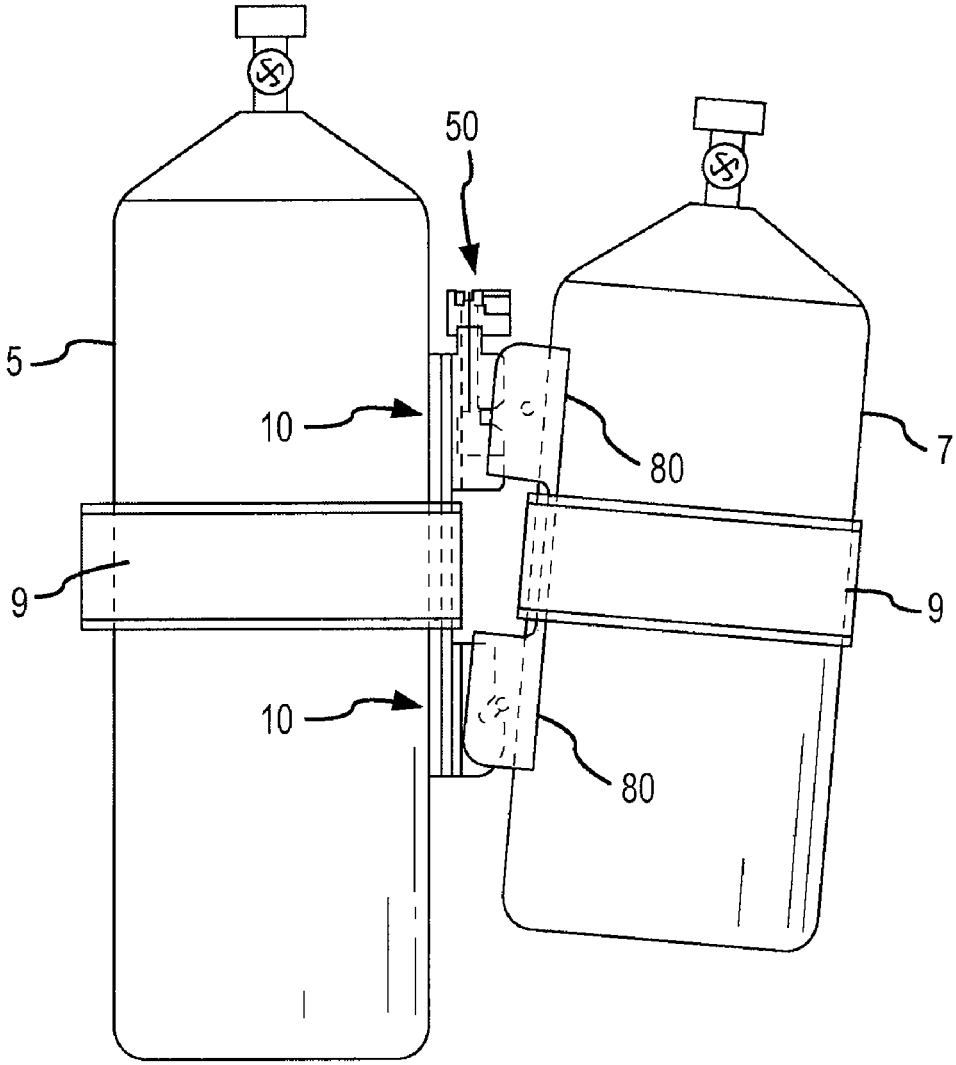
FIG. 1 shows an exemplary main tank and pony tank positioned for being combined in accordance with one embodiment of the invention.
Figure 2:
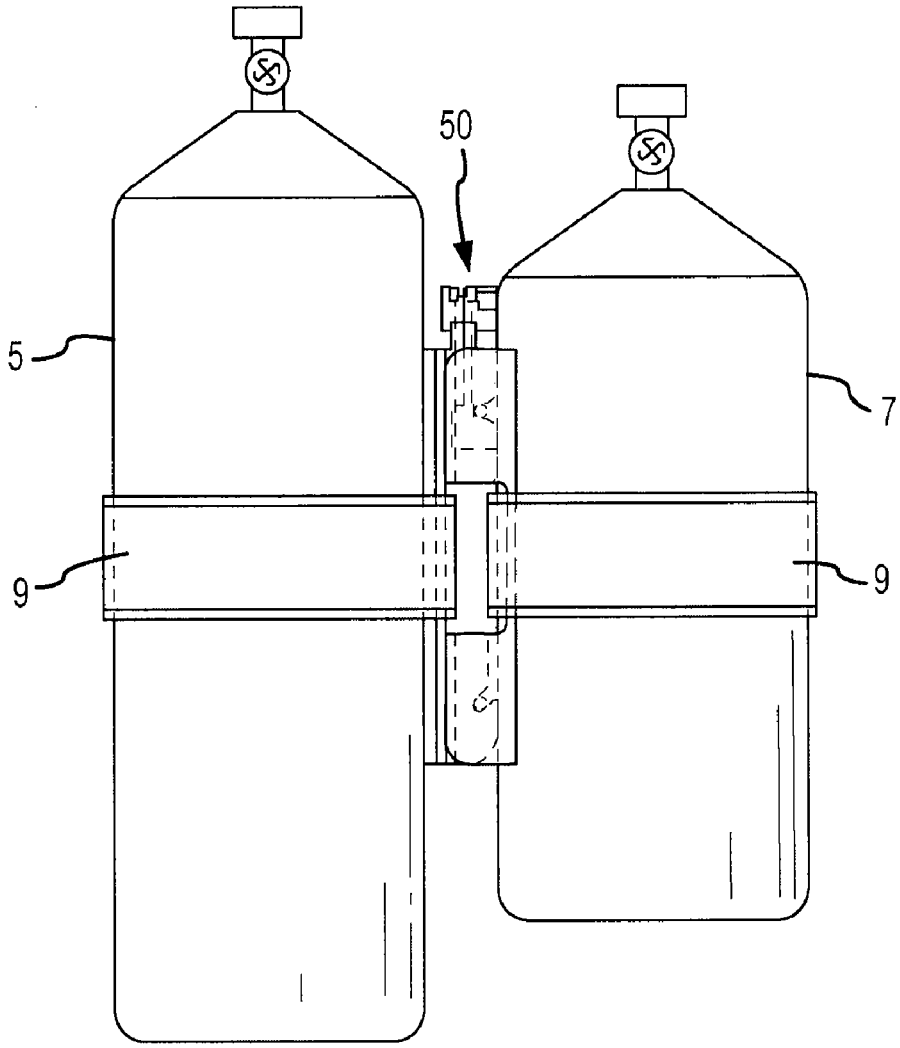
FIG. 2 shows an exemplary main tank and pony tank in a combined positioned in accordance with one embodiment of the invention.

The detailed description of exemplary embodiments of the invention herein makes reference to the accompanying drawings, which show the exemplary embodiment by way of illustration and its best mode. While these exemplary embodiments are described in sufficient detail to enable those skilled in the art to practice the invention, it should be understood that other embodiments may be realized and that logical and mechanical changes may be made without departing from the spirit and scope of the invention. Thus, the detailed description herein is presented for purposes of illustration only and not of limitation. Moreover, the invention contemplates that any of the components discussed herein in singular form may also include one or more of such components. Similarly, the invention contemplates that any components discussed herein in plural form may also include a single component.

The invention includes any system or method for attaching, storing, mounting, securing and/or transporting items of similar or different sizes. The items may include, for example, canisters, cylinders, cylindrical objects, tubes, pipes, bars, rods, posts, bottles, and/or tanks. The tanks may include, for example, chemical tanks (e.g., fire extinguishers and related chemicals), gas tanks (e.g., Nitrogen, Helium, Nitrox, Argon, Inert And Oxygen). Such items are typically mounted, fastened, held, secured, safe-guarded, transported and/or located in a manner such that the items are easily accessible. The items may be permanently or removeably mounted by a bracket, wherein the bracket may be attached to any surface such as, for example, a flat surface, round surface, a curved surface, a wall, floor, ceiling, deck, room partition, round cylindrical object, tube, pipe, bar, rod, post, bottle, canister, tank and/or the like.

The items may be used by, found in, or required by law to be in such places such as, for example, industrial facilities, manufacturing facilities, institutional, schools and office buildings, large and small businesses, emergency vehicles (e.g., police, fire, rescue, ambulance, auxiliary), transportation vehicles (e.g., airplanes, helicopters, boats, ships, trains, cars, trucks and buses), and non-motorized vehicles (e.g., carts, bicycles, hospital beds or wheelchairs). In one embodiment, the invention includes a base unit bracket 10 (or latch device) to mount, attach, store, transport and/or secure a spare tank (e.g., pony bottle tanks) to a main tank used in scuba diving (e.g., recreational or professional). The components of the invention are configured in a simplified manner such that the diver may easily service the invention with limited mechanical abilities, along with rebuilding the invention with spare parts which may be re-ordered from the manufacturer.

The invention generally includes, in one embodiment, release brackets, clamps, and a locking mechanism 50. The release brackets may include, for example, a base unit bracket 10 and a top unit bracket 80 which may be interlocked, joined, attached, secured, mounted, or assembled together. One or more release brackets may be mounted on either the main tank and/or pony tank. Each of these brackets are permanently or temporarily secured to an item, such as, for example, a pony bottle or main tank via any securing device comprised of any material such as, for example, a cam belt, cam bands, and/or stainless steel straps (e.g., hose clamps). In one embodiment, the surface mount on the base unit bracket 10 includes slots used for screws (or some other type of fastener) to mount the bracket to a surface. In an exemplary embodiment, the bracket includes six or eight slots 12 with three or four slots, respectively, on each side, wherein each slot is 7⁄32 or 0.225 inches wide. In another embodiment, the bracket may be about 6.0 or 11.75 inches in length and include no slots or any number of slots 12 in any configuration or location.

The brackets or any other component discussed herein may be comprised of any suitable material or composite of materials such as, for example, aluminum, stainless steal or plastic materials. The aluminum materials may include, for example, 2024, series 6000 and 7000 in billet form, a casting aluminum material, a forged aluminum material.

The brackets also eliminate or reduce the use of any items which may entangle the diver or entangle other objects in the diver's surroundings (e.g., no string, cord, chain or lanyards). In one embodiment, the release brackets are bidirectional (e.g., reversible) such that the top bracket mount may be rotated between about 0 and 180 degrees. With a proper tank setup, the bracket allows the tanks to be exchangeable or interchangeable from an empty tank to a fresh re-filled or new full tank. With a proper tank setup, the bracket also allows the tanks to be transferable from unit to unit or from person to person. The same bracket may also be utilized for mounting other accessories (e.g., battery packs, lights, canisters and the like).

Figure 3C:
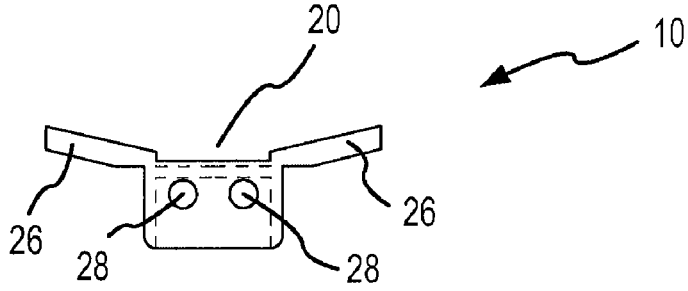
FIG. 3C shows a top side view of an exemplary main tank base unit bracket 10 in accordance with one embodiment of the invention.
Figure 3A:
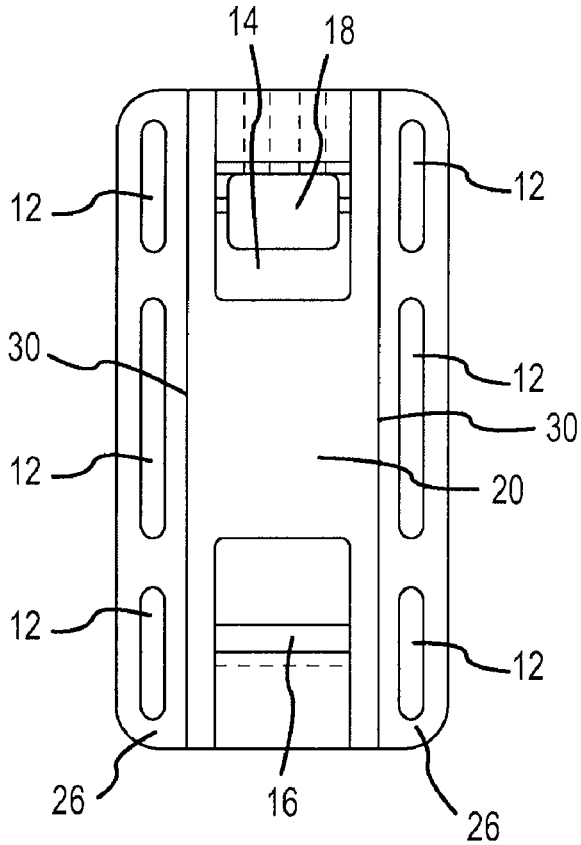
FIG. 3A shows a front view of an exemplary main tank base unit bracket 10 in accordance with one embodiment of the invention.
Figure 3B:
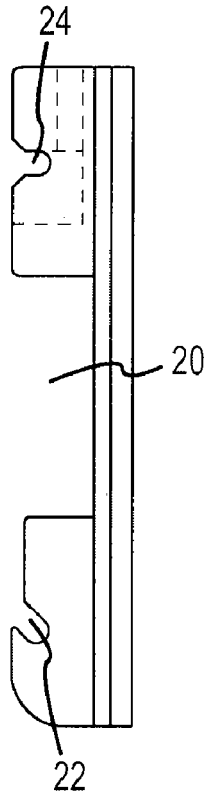
FIG. 3B shows a side view of an exemplary main tank base unit bracket 10 in accordance with one embodiment of the invention.

With respect to FIGS. 3A-3C, in an exemplary embodiment, base unit bracket 10 includes one or more mounting slots 12, an upper interface hub 14, a bottom interface hub 16, pocket 18. In an exemplary embodiment, base unit bracket 10 starts with material having dimensions of about 1.5×3×6.25 inches, then the finished size is about 1.10×3.0×6.0 inches. Mounting slots 12 are about 0.225 inches wide and 1.210 inches in length with a 0.1125 inside radial curve at the ends of the mounting slots 12. The center mounting slots 12 are about 2.200 inches in length and may be spaced apart from the other mounting slots 12 by 0.480 inches. In one embodiment, six mounting slots 12 (three on each side) are located on the outer edges of base unit bracket 10. Pocket 18 is configured to receive locking mechanism 50, and particularly base unit sliding lock latch 60. Pocket 18 is configured with dimensions of about 0.645 height×1.000 wide×0.650 Depth (in inches).

The vertical axis of base unit bracket 10 includes two interfacing or interlocking hubs 14, 16 with dimensions of about 0.750×1.25×1.900 inches with a clearance gap 20 (or space) between the two hubs of about 2.2 inches. Hubs 14, 16 fit in between the mating part of the top unit bracket 80 (see FIG. 4A). Clearance gap 20 is configured to allow straps to wrap around to secure Main Tank and base unit bracket 10.

With respect to FIG. 3B, slot 22 is near a first end and catch 24 is near a second end and are configured to accept either one of the two 3/16 dowel pins 82, 84 from top unit bracket 80 upon activation of push button. Catch 24 is about 0.218 inches wide with a chamfer on each side, wherein the chamfer is about 0.125×45 inches. Catch 24 terminates about 0.236 inches from the front face and is located about 0.875 inches from the second end. Slot 22, in an exemplary embodiment, includes an about 45 degree slot that is about 0.218 wide, with one side of the slot starting about 0.125 inches above the other side of the slot. Slot 22 terminates about 0.236 inches from the front face and is located about 0.875 inches from the first end. Clearance gap 20 is also configured to receive top unit bracket 80.

With respect to FIG. 3C, side flanges 26 are set on both sides of clearance gap 20 and are angled away from each other. Clearance gap 20 is about 1.00 inch wide. In an exemplary embodiment, side flanges 26 are angled away from clearance gap 20, and in one embodiment, side flanges 26 include about 13 degree angle contours with a total of about 154 degree range of the contour such that side flanges 26 nest against a surface (e.g., of a Main Dive Tank with a standard 7-8 inch diameter). Holes 28 are configured to receive locking mechanism 50. In one embodiment, holes 28 include two 0.250 inch diameter holes which are each configured to receive a bolt (e.g., stainless shoulder bolt 54). In another embodiment, side flanges 26 include one or more notches 30 (e.g., undercut) near long mounting slots 12 to enable strap 9 to be recessed against side flanges 26 such that base unit bracket 10 lays substantially flat against main tank.

Figure 4C:
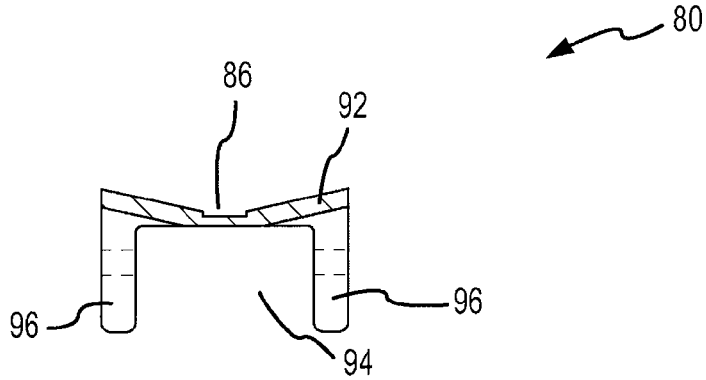
FIG. 4C shows a top side view of an exemplary pony tank top unit bracket 80 in accordance with one embodiment of the invention.
Figure 4A:
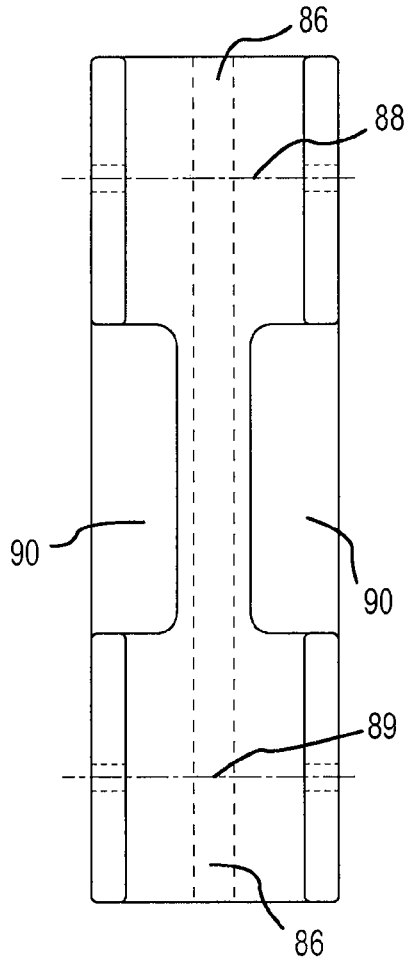
FIG. 4A shows a front view of an exemplary pony tank top unit bracket 80 in accordance with one embodiment of the invention.
Figure 4B:
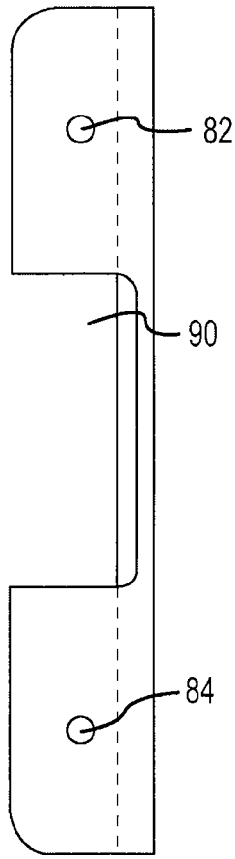
FIG. 4B shows a side view of an exemplary pony tank top unit bracket 80 in accordance with one embodiment of the invention.
Figure 5A:
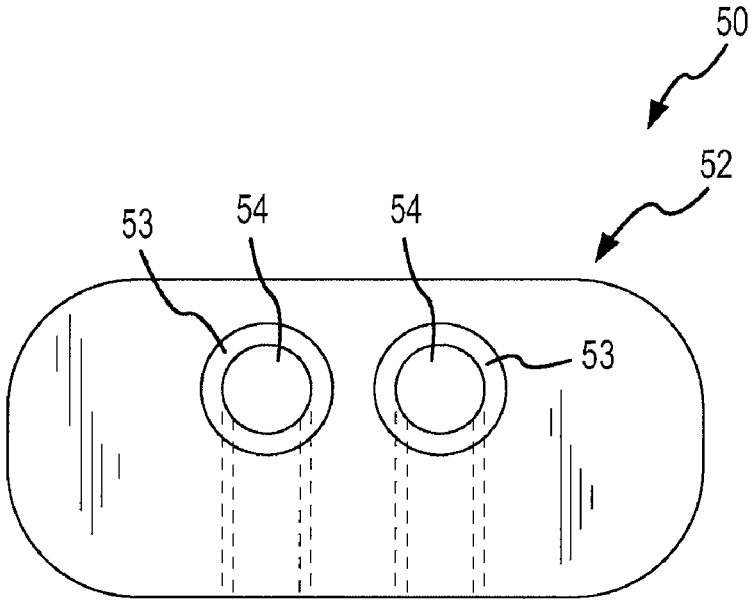
FIG. 5A shows a top view of a main tank base unit bracket 10 push button in accordance with one embodiment of the invention.
Figure 5B:
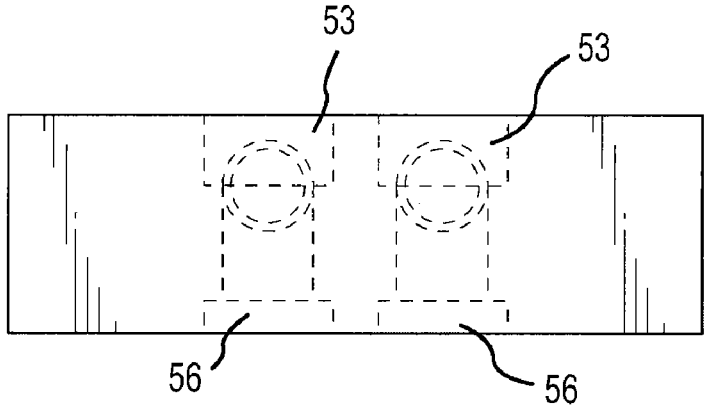
FIG. 5B shows a side view of a main tank base unit bracket 10 push button in accordance with one embodiment of the invention.
Figure 6B:
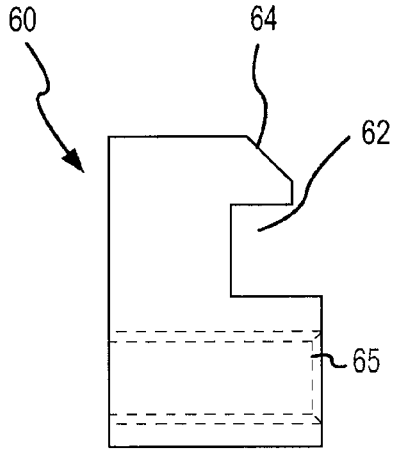
FIG. 6B shows a side view of an exemplary main tank base unit sliding lock latch 60 in accordance with one embodiment of the invention; and, FIG. 6C shows a top view of an exemplary main tank base unit sliding lock latch 60 in accordance with one embodiment of the invention.
Figure 6A:
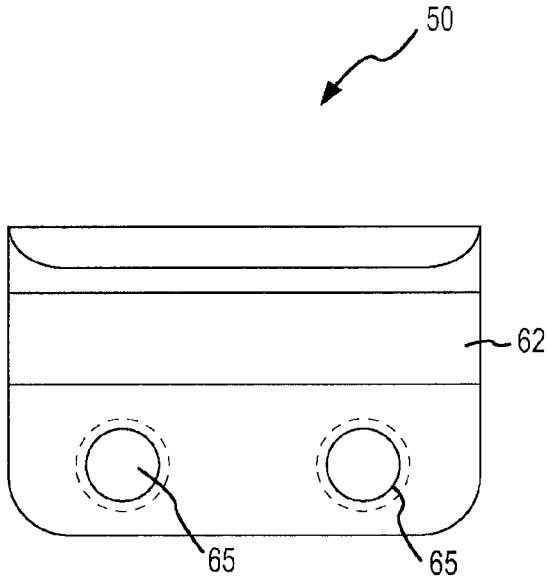
FIG. 6A shows a front view of an exemplary main tank base unit sliding lock latch 60 in accordance with one embodiment of the invention.
Figure 6C:
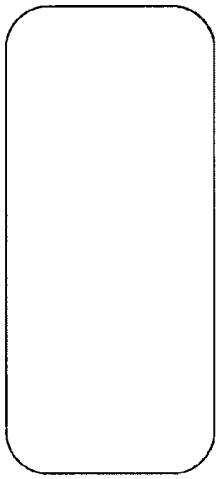
Figure 7:
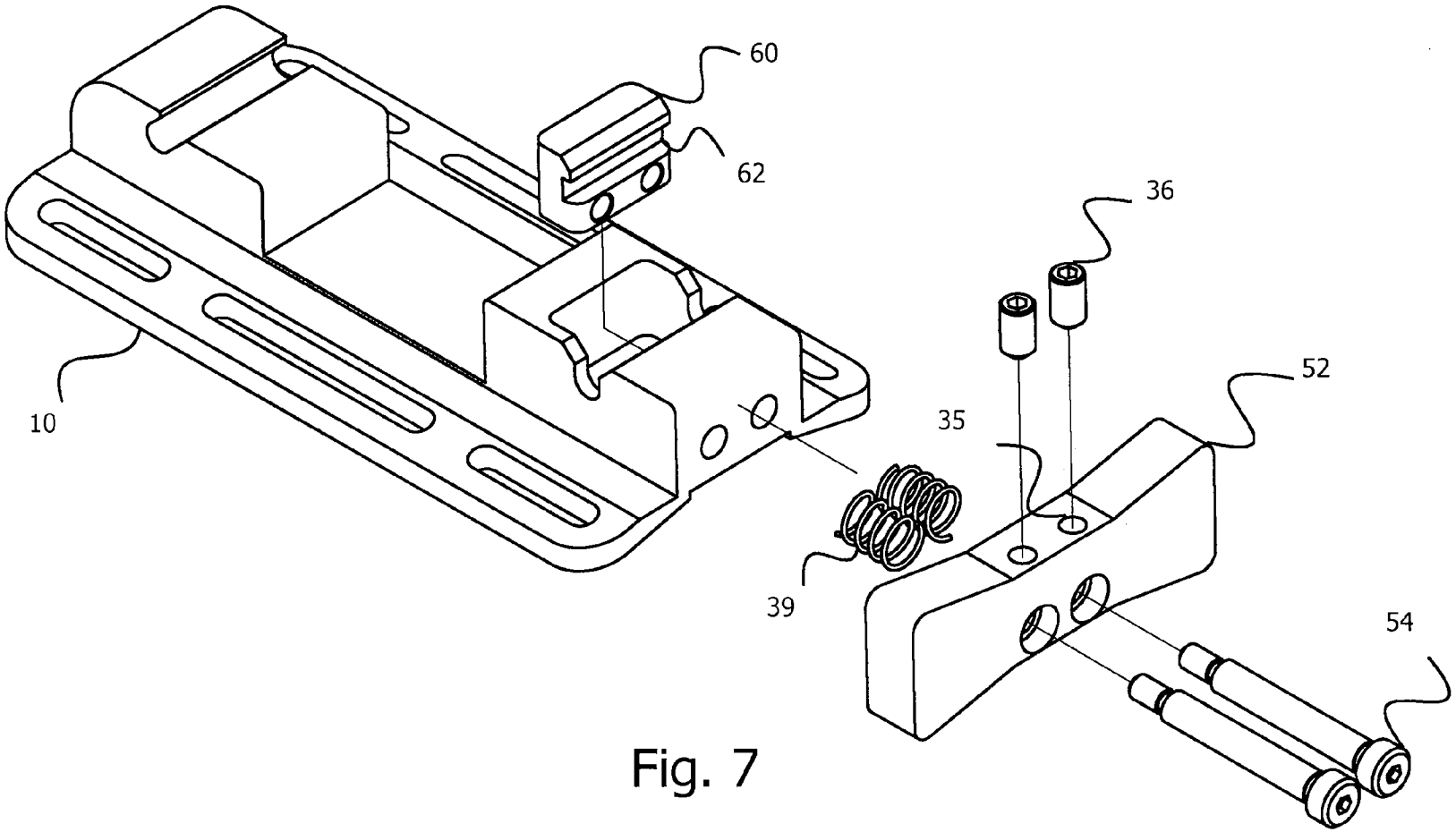
FIG. 7 shows an exploded view of an exemplary main tank base unit bracket and the various exemplary components of the locking mechanism, in accordance with one embodiment of the invention.
Figure 8:
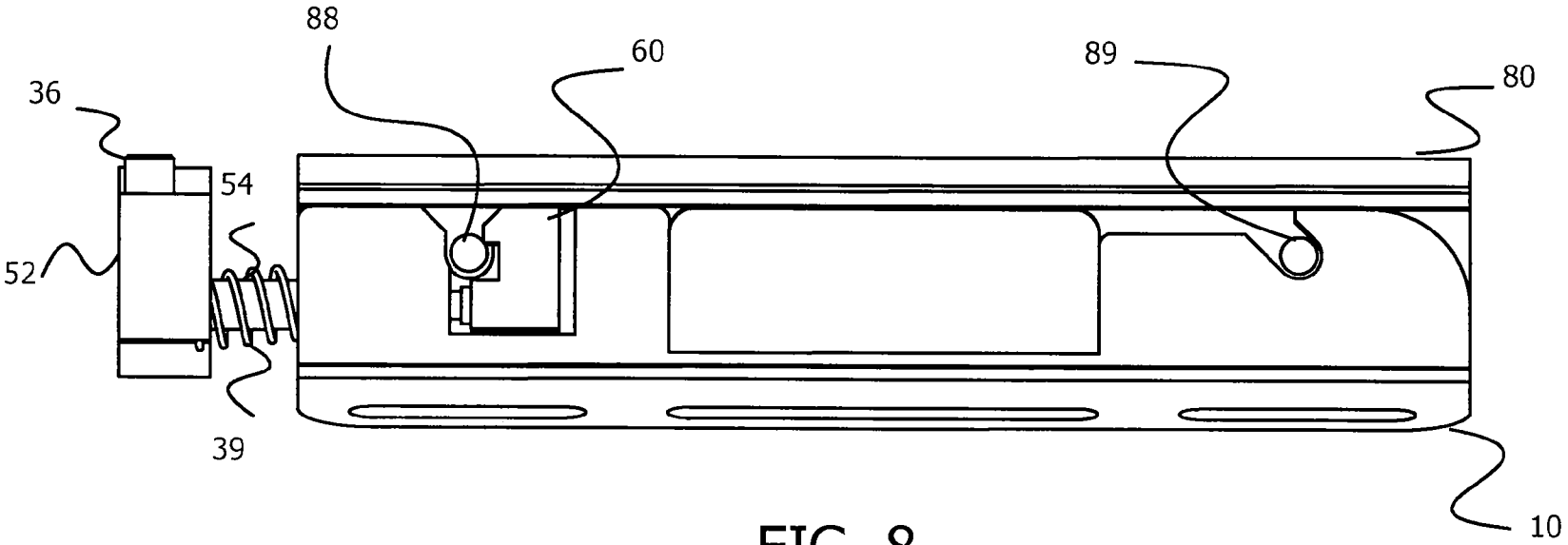
FIG. 8 shows a side view of an exemplary main tank base unit bracket, the various exemplary components of the locking mechanism, and a pony tank top unit bracket, in accordance with one embodiment of the invention.

Top unit bracket 80, with respect to FIGS. 4A-4C, starts with material having dimensions of about 1.5×2.0×6.0 inches, then the finished size is about 1.017×1.750×6.0 inches. Top unit bracket 80 includes at least one dowel pin 88, 89 to engage slots 22, 24, respectively, within base unit bracket 10. In one embodiment, top unit bracket 80 includes two dowel pins 88, 89 and each dowel pin dimensions are about 3/16 inch×1.750 inches. As used herein, dowel pins 88, 89 may comprise any shape or material (e.g., hook, ball, peg, block, etc) suitably configured to engage at least one of lock latch 60, slot 22 and catch 24. Cross holes 82, 84 are configured to receive and hold dowel pins 88, 89, respectively. In one embodiment, cross holes 82, 84 are located about 0.875 inches from each end of top unit bracket 80 and about 0.500 inches from the front of top unit bracket 80. Cross holes 82, 84 have a diameter of about 0.187 inches and are separated about 4.250 inches apart from each other. Top unit bracket 80 includes at least one gap 90 which is about 2.200 inches in length with 0.125 inch internal radius corners. Gap 90 is configured to allow the cam band 9 to wrap around top unit bracket 80 to suitably secure the Pony Tank to the top unit bracket 80. In one embodiment, the width of top unit bracket 80 is 1.750 inches, the height is about 1.017 inches, and the length is about 6.00 inches.

With respect to FIG. 4A, top unit bracket 80 includes two interfacing or interlocking slots 86 which are configured to mate with the interfacing or interlocking hubs 14, 16 of the base unit bracket 10 when joined. Slots 86 run along the length of top unit bracket 80 along about the vertical axis. Slots 86 are configured with a width of about 1.258 inches and 0.753 inch depth from the top edge. The wall thickness of about 0.246 is between slots 86 with overall outside dimension of about 1.750 inches. The symmetrical dimensions of about 0.875 inches from each end of top unit bracket 80 and the 0.500 inches from the top edge relate to the centerlines of the two cross holes 82, 84, as best shown in FIG. 4B. Two 0.1875 inch diameter dowel pins are pressed in and straddle across slots 82, 84 to form a catch device or a place for which base unit bracket 10, locking mechanism 50 and base unit sliding lock latch 60 is captured or engaged around one of these two pins.

With respect to FIG. 4C, top unit bracket 80 includes two about 13 degree contours 92 (total degree range about 154 degrees) about 0.122 inches thick and configured to abut the outside diameter of an item such as, for example, a Pony Tank with a standard diameter from about 4-8 inches. The angled contours are opposite to each other and terminate at recess gap 86 which is about 0.300 inches in width and 0.75 inches thick. Gap 94 is about 1.258 inches in width and is configured to receive hubs 14, 16 when joined with base unit bracket 10. Side walls 96 surround gap 94 with a 0.032 radial curve at the intersection of side wall 96 and the bottom of gap 94 and a 0.063 radial curve which forms the top of side wall 96.

Locking mechanism 50 includes, with respect to FIGS. 5-8, a base unit sliding lock latch 60, catch 62, a push button 52, shoulder bolts 54, set screws 36, set screw holes 35, and compression springs 39. In an exemplary embodiment, locking mechanism 50 includes two 0.25 inch ×1.5 inch shoulder bolts 54, two compression springs 39 (0.360 inch ×0.5 inch) with 0.035 inch diameter wire, and two 0.25-20× 0.375 inch set screws 36. With respect to FIG. 5, push button 52 is about 2.000 inches in length, 0.900 inches wide and 0.625 inches in height, with 0.375 radial curves on the side walls. In another embodiment, push button 52 is formed in a bow-tie configuration such that push button 52 includes a larger surface area for easier activation.

Shoulder bolt 54 is configured with about 0.250 diameter and 1.5 inch in length with a 10-24 thread at the bottom of the bolts. Two about 0.375 inch counter bores 53 are included for the head of the shoulder bolts 54. The shoulder bolt holes are created using a ¼ drill 0.625 inches deep. The centers of shoulder bolts 54 are about 0.500 inches apart and terminate about 0.100 inches from the bottom of push button 52. The two ¼-20 tap holes are about 0.200 inches deep and are configured to receive the two set screws that lock against the shoulder bolts 54 to prevent the shoulder bolts 54 from loosening. Counter bores 56 are configured to receive compression springs. With respect to FIG. 6, base unit sliding lock latch 60 is about 0.450 inches wide, includes about 0.125 inch radial curves on the outer edges, two 10-24 tap holes 65 spaced apart about 0.500 inches, and a 45 degree chamfer 64 above slot 62. Slot 62 is about 0.192 inches and is configured such that one of the two 3/16 dowel pins 82, 84 from top unit bracket 80 is locked or latched against slot 62.

In an exemplary embodiment, certain hardware components (e.g., shoulder bolts, compression springs, set screws and dowel pins) may comprise stainless steel type 18-8, 302, 304 and 316 grade. The locking mechanism 50, in one embodiment, is self-contained, thereby eliminating or minimizing the use of separate components (e.g., no clevis, hitch, cotter or quick release pins) which may be lost. In an exemplary embodiment, only one ⅛ allen key or ⅛ allen wrench is needed to assemble or disassemble the locking mechanism 50 for easy cleaning.

To construct push button 52, one of the two shoulder bolts 54 is placed through one of holes and seated against the counter bores 53. A set screw is screwed into each hole, but the set screw is not yet tightened against the shoulder bolt 54. The compression spring is then slid over each bolt (near 56) up to the bottom or seat of counter bore of push button 52. Sliding lock latch 60 is placed into the pocket 18 of base unit bracket 10 with threaded holes facing downward and parallel to holes 28, and with the groove 62 facing upwards to holes 28. The partially assembled locking mechanism 50 is placed through holes 28. Shoulder bolts 54 are then screwed (or threaded) and tightened into sliding lock latch 60 until it is fully seated. Set screws are then tightened against shoulder bolts 54. Upon pushing push button 52, locking mechanism 50 moves sliding lock latch 60 such that sliding lock latch 60 retracts with minimal or no binding.

To interlock the brackets, main tank is 90 degrees (or standing straight up) and pony tank is rotated, tilted, or set to about a 5 degree angle. The bottom dowel pin on top unit bracket is inserted into the 45 degree angled slot of the base unit bracket 10. The base unit bracket 10 Push Button is then pushed to engage the upper dowel pin into the catch of the base unit bracket 10 to form an interlocked unit or system.

Benefits, other advantages, and solutions to problems have been described herein with regard to specific embodiments. However, the benefits, advantages, solutions to problems, and any element(s) that may cause any benefit, advantage, or solution to occur or become more pronounced are not to be construed as critical, required, or essential features or elements of any or all the claims or the invention. It should be understood that the detailed description and specific examples, indicating exemplary embodiments of the invention, are given for purposes of illustration only and not as limitations. Many changes and modifications within the scope of the invention may be made without departing from the spirit thereof, and the invention includes all such modifications. Corresponding structures, materials, acts, and equivalents of all elements in the claims below are intended to include any structure, material, or acts for performing the functions in combination with other claim elements as specifically claimed. The scope of the invention should be determined by the appended claims and their legal equivalents, rather than by the examples given above.

What is claimed is:

1. A mounting system for mounting a first item to a second item, said system comprising:

a base unit bracket having a clearance gap with a band for removably attaching to said first item, wherein said base unit bracket includes a locking mechanism having a push button, a lock latch and a catch, wherein said push button, said lock latch and said catch are on a first axis;

said push button translates said lock latch along said first axis to allow said catch to receive at least one of: a first dowel pin and a second dowel pin within said catch; and, a top unit bracket having a clearance gap with a band for removably attaching to said second item, wherein said top unit bracket includes said first dowel pin and a second dowel pin.

2. The system of claim 1, wherein said first item is a main tank.

3. The system of claim 1, wherein said second item is a pony tank.

4. The system of claim 1, wherein said top unit bracket is configured to removably attach to a second item with at least one of an adjustable band strap and belt.

5. The system of claim 1, wherein said base unit bracket is configured to removably attach to a first item with at least one of an adjustable band strap and belt.

6. The system of claim 1, wherein said base unit bracket further comprises a slot configured to receive said second dowel pin.

7. The system of claim 1, wherein said base unit bracket further comprises an angled slot configured to receive said second dowel pin.

8. The system of claim 1, wherein said top unit bracket further comprises a clearance gap, wherein said clearance gap is configured to allow straps to wrap around said top unit bracket and said second item.

9. The system of claim 1, wherein said locking mechanism is configured to be at least one of assembled and disassembled with at least one of an allen wrench and allen key.

10. The system of claim 1, wherein said push button is configured in a bow tie configuration.

11. A method for mounting a first item to a second item, said method comprising:

removably attaching a base unit bracket having a clearance gap with a band to said first item, wherein said base unit includes a locking mechanism having a push button, a lock latch and a catch, wherein said push button, said lock latch and said catch are on a first axis;

removably attaching a top unit bracket having a clearance gap with a band to said second item, wherein said top unit bracket comprises a first dowel pin and a second dowel pin;

pressing said push button to move said lock latch along said first axis to allow said lock latch to receive said first dowel pin into said catch;

inserting at least one of: said first dowel pin and said second dowel pin into said catch; and, releasing said push button to retain at least one of: said first dowel pin and said second dowel pin within said catch.

12. The method of claim 11, wherein said step of removably attaching a base unit bracket to said first item comprises removably attaching said base unit bracket to a main bottle.

13. The method of claim 11, wherein said step of removably attaching a top unit bracket to said second item comprises removably attaching said top unit bracket to a pony bottle.

14. The method of claim 11, wherein said step of removably attaching said base unit bracket to said first item comprises removably attaching said base unit bracket to said first item using at least one of an adjustable band strap and belt.

15. The method of claim 11, wherein said step of removably attaching said base unit bracket to said first item comprises removably attaching said base unit bracket to said first item using at least one of an adjustable band strap and belt through a clearance gap of said base unit bracket.

16. The method of claim 11, wherein said step of removably attaching a top unit bracket to said second item comprises removably attaching said top unit bracket to said second item using at least one of an adjustable band strap and belt.

17. The method of claim 11, further comprising inserting a second dowel pin of said top unit bracket into a slot of said base unit bracket.

18. The method of claim 11, further comprising inserting a second dowel pin of said top unit bracket into an angled slot of said base unit bracket.

* * * * *